US005521619A

United States Patent [19]

Suzuki et al.

[11] Patent Number: 5,521,619

[45] Date of Patent: May 28, 1996

[54] INK JET TYPE RECORDING APPARATUS THAT CONTROLS INTO MENISCUS VIBRATIONS

[75] Inventors: Kazunaga Suzuki; Tomoaki Abe; Shoichi Hiraide, all of Nagano, Japan

[73] Assignee: Seiko Epson Corporation, Tokyo, Japan

[21] Appl. No.: 145,643

[22] Filed: Nov. 4, 1993

[30] Foreign Application Priority Data

Nov. 5, 1992 [JP] Japan ..... 4-296107
Oct. 18, 1993 [JP] Japan ..... 5-284040

[51] Int. Cl.[6] ..... B41J 2/045

[52] U.S. Cl. ..... 347/10; 347/68

[58] Field of Search ..... 347/10, 11, 12, 347/19, 66

[56] References Cited

U.S. PATENT DOCUMENTS 4,972,211 11/1990 Aoki ..... 347/11
5,359,350 10/1994 Nakano et al. ..... 347/10

FOREIGN PATENT DOCUMENTS 0049900 4/1982 European Pat. Off. .
0145130 6/1985 European Pat. Off. .
2418089 9/1979 France .
2555749 6/1977 Germany .

*Primary Examiner*—Benjamin R. Fuller
*Assistant Examiner*—Craig A. Hallacher
*Attorney, Agent, or Firm*—Sughrue, Mion, Zinn, Macpeak & Seas

[57] ABSTRACT

The apparatus includes a circuit 49 for generating a first voltage waveform for expanding piezoelectric vibrators at a rate suitable to form ink drops, a second voltage for holding an expansion or contraction state, and a third voltage waveform for contracting the piezoelectric vibrators at a rate suitable to suck ink into pressure generating chambers; a circuit 52 for detecting the time when the process of forming ink drops by the first voltage waveform is ended; a delay circuit 53 for delaying a signal from the circuit 52 by a time ΔT until vibration of menisci caused by the ink drop formation process, switches to motion toward nozzle openings; a charge signal generating circuit 48 for generating the third voltage waveform on the basis of a signal from the delay circuit 53; and a discharge signal generating circuit 51 for generating the first voltage waveform on the basis of a print timing signal. The third voltage waveform is generated when the menisci produced after forming ink drops have started moving toward the nozzle openings, so that ink required for the next formation of ink drops is sucked into the pressure generating chambers. Therefore, the force to retreat the menisci due to the expansion of the pressure generating chambers is canceled by motion of the menisci per se, and the retreat of the menisci caused by the suction of ink can be minimized. It is therefore possible to stabilize the menisci independently of the frequency.

3 Claims, 10 Drawing Sheets

FIG. 4A PRIOR ART PRINT TIMING SIGNAL

FIG. 4D PRIOR ART TERMINAL VOLTAGE OF PIEZOELECTRIC VIBRATOR

FIG. 4E PRIOR ART POSITION OF MENISCUS

PRINT SECTION SIGNAL
41
EDGE DETECTING CIRCUIT
54
40
45
46
A
B
S
47
S
Q
R
48
CHARGE SIGNAL GENERATING CIRCUIT
IN 1
49
DRIVING SIGNAL GENERATING CIRCUIT
IN 2
50
1ST DELAY CIRCUIT
51
DISCHARGE SIGNAL GENERATING CIRCUIT
53
2ND DELAY CIRCUIT
52
DISCHARGE END DETECTING CIRCUIT
43
D
Q
CLK
PRINTDATA PRESENCE/ABSENCE SIGNAL
44
PRINT TIMING SIGNAL
42
8
8
Tr
Tr
D1
D2

PRINT SECTION SIGNAL
41
EDGE DETECTING CIRCUIT
54
40
45
46
A
B
S
47
S
Q
R
48
CHARGE SIGNAL GENERATING CIRCUIT
IN 1
49
DRIVING SIGNAL GENERATING CIRCUIT
IN 2
63
50
1ST DELAY CIRCUIT
51
DISCHARGE SIGNAL GENERATING CIRCUIT
53
2ND DELAY CIRCUIT
52
DISCHARGE END DETECTING CIRCUIT
60
62
61
D
Q
CLK
43
PRINTDATA PRESENCE/ABSENCE SIGNAL
44
PRINT TIMING SIGNAL
42
RESET SIGNAL
Tr
8
D1
D2

INK JET TYPE RECORDING APPARATUS THAT CONTROLS INTO MENISCUS VIBRATIONS

BACKGROUND OF THE INVENTION

1. Industrial Field of Utilization

The present invention relates to a recording apparatus using an on-demand ink jet type recording head, and more particularly to an ink jet type recording head having a driving circuit for forming ink drops at rapid repetition rate.

2. Related Art

An on-demand ink jet type recording head is constituted by a nozzle plate in which a plurality of nozzle openings are formed in one and the same substrate and a spacer for forming pressure generating chambers communicating with the respective nozzle openings so that the pressure generating chambers are expanded/contracted in accordance with print timing signals to thereby perform suction/ejection of ink into/from the pressure generating chambers.

FIG. 1 shows one example of a known ink jet type recording head, and in FIG. 1 the reference numeral 1 represents a nozzle plate having nozzle opening arrays 3, 3, 3 . . . each of which is provided with nozzle openings 2, 2, 2 . . . formed at a predetermined pitch, for example, 180 DPI.

The reference numeral 4 represents a spacer which is to be disposed between a vibration plate 5, which will be described by and by, and the nozzle plate 1, in which spacer through hole arrays 6, 6, 6 . . . for forming reservoirs (not shown), or pressure generating chambers, corresponding to the nozzle arrays are formed in positions corresponding to the nozzle opening arrays, 2, 2, 2 . . .

The reference numeral 5 represents a vibration plate which forms the pressure generating chambers by facing the nozzle plate 1 with the spacer 4 interposed. The vibration plate 5 is disposed so as to be in contact with the tops of piezoelectric vibrators 8, 8, 8 . . . of piezoelectric vibrator units 7, 7, 7 . . . , which will be described later, to thereby contract/expand the pressure generating chambers in response to the expansion/contraction of the piezoelectric vibrators 8, 8, 8 . . .

The reference numeral 9 represents a substrate provided with unit reception holes 10, 10, 10 . . . for receiving the vibrator units 7, 7, 7 . . . so as to expose the free end sides of the piezoelectric vibrators 8, 8, 8 . . . , and an ink supply port 11 for supplying ink from an ink tank into the reservoirs. On the surface of the substrate 9, the vibration plate 5, the spacer 4 and the nozzle plate 1 are positioned and fixed by a frame body 12 which acts also as an electrostatic shield so as to be assembled into a recording head body, so that pressure generating chambers 15 are formed by the spacer 4, the nozzle plate 1 and the vibration plate 5, as shown in FIG. 2, the chambers being supplied with ink from reservoirs 17, 17 through ink supply ports 16, 16.

FIG. 3 shows a driving signal generating circuit suitable to drive the above-mentioned recording head. In FIG. 3, the reference numerals $IN_1$ and $IN_2$ represent a print preparation signal input terminal and a print signal input terminal to which a pulse-shaped charge signal $P_c$ as a print preparation signal and a pulse-shaped discharge signal $P_d$ as a print signal are respectively applied in accordance with a print timing signal as shown in FIG. 4A.

The reference numeral 21 represents a level adjusting transistor which has a base electrode connected to the input terminal $IN_1$ and a collector electrode connected to a base electrode of a first switching transistor 22. Emitter and collector electrodes of the first switching transistor 22 are connected to a power source terminal $V_H$ through a time constant adjusting resistor 23 and to the ground through a time constant adjusting capacitor 24 respectively. The reference numeral 25 represents a constant current control transistor which has an emitter electrode connected to the power source terminal $V_H$, a collector electrode connected to the collector electrode of the level adjusting transistor 21, and a base electrode connected to the power source terminal $V_H$ through the time constant adjusting resistor 23.

On the other hand, a second switching transistor 26 has a base electrode connected to the input terminal $IN_2$, a collector electrode connected to the time constant adjusting capacitor 24, and an emitter electrode connected to the ground through a second time constant adjusting resistor 27.

The reference numeral 28 represents a constant current control transistor having a collector electrode connected to the input terminal $IN_2$, an emitter electrode connected to the ground, and a base electrode also connected to the ground through the second time constant adjusting resistor 27.

The reference numerals 29, 30, 31 and 32 represent transistors constituting a current buffer for amplifying a current at the time of charging and discharging the capacitor 24. In the illustrated embodiment, the transistors 29 and 30, and 31 and 32 are Darlington-connected to have enough current capacitance to drive piezoelectric vibrators of the ink jet recording head to be driven.

The operation of the thus configured driving signal generating circuit will be described. If the recording head moves by a unit distance, a print timing signal (FIG. 4A) for forming a dot is generated from a host. A charge signal $P_c$ (FIG. 4B) of having a pulse width $T_c$ is generated in synchronism with the print timing signal. This pulse width $T_c$ is set to correspond to a sufficient time to allow ink to enter into a pressure generating chamber if the piezoelectric vibrator used is of a d31 type in which the vibrator is contracted by charging. If this signal is supplied to the input terminal $IN_1$, the level adjusting transistor 21 is turned on, and hence the first switching transistor 22 is also turned on. Consequently, the power source voltage of the power source terminal $V_H$ is applied to the capacitor 24 through the time constant adjusting resistor 23 so that this capacitor 24 is charged with a time constant depending on the resistor 23 and the capacitor 24.

The time constant adjusting resistor 23 is connected at its opposite ends to the constant current control transistor 25 so that the terminal voltage across the resistor 23 is maintained to the voltage between the base and emitter electrodes of the transistor 25 and the current flowing into the capacitor 24 becomes constant without changing over time. As a result, the leading edge gradient $\tau 1$ of the terminal voltage (V) of the capacitor 24 can be expressed by the following equation:

$$\tau 1 = V_{BE1}/(R_1 \times C_1)$$

where $R_1$ represents the resistance of the resistor 23, $C_1$ represents the capacitance of the capacitor 24, and $V_{BE1}$ represents the base-emitter voltage of the constant current transistor 25. The pulse width $P_{wc}$ of the charge signal $P_c$ is set to a sufficient time to charge the capacitor 24 up to the voltage $V_0$ of the power source terminal $V_H$.

After the time corresponding to the pulse width $T_c$ of the charge signal $P_c$ has thus passed, the terminal voltage of the capacitor 24 is increased up to the power source voltage $V_0$. The charge signal $P_c$ is switched to an L level at this time, so that the level adjusting transistor 21 is turned off, and hence the first switching transistor 22 is also turned off. As a result, the capacitor 24 keeps the voltage $\tau \times T_c = V_0$.

If a discharge signal $P_d$ (FIG. 4C) as a print signal is supplied to the terminal $IN_2$ when a predetermined time $P_{wh}$ has passed since the moment the charge signal $P_c$ was turned off, the second transistor 26 is turned on to form a loop for discharging the charges of the capacitor 24.

As a result, the charges accumulated in the capacitance $C_1$ are discharged through the time constant adjusting resistance R2 of resistor 27. At the same time, the constant current control transistor 28 is turned on so that the terminal voltage of the second time constant adjusting resistor 27 is made equal to the base-emitter voltage $V_{BE2}$ of the transistor 28 by the same effect as the above-mentioned effect of the first constant current control transistor 25, so that the terminal voltage (V) of the capacitance $C_1$ drops with a constant gradient.

That is, the trailing edge gradient $\tau 2$ can be expressed by the following equation:

$$\tau 2 = -V_{BE2}/(R_2 \times C_1)$$

where $R_2$ represents the resistance of the second time constant adjusting resistor 27, $C_1$ represents the capacitance of the capacitor 24, and $V_{BE2}$ represents the base-emitter voltage of the constant current transistor 28. The pulse width $P_{wd}$ of the discharge signal $P_d$ is set to a sufficient time to discharge the capacitor 24 down to zero potential.

The voltage changing at a predetermined leading edge speed and a trailing edge speed depending on the time constant adjusting resistors 23 and 27 and the capacitor 24 in such a manner as described above is amplified by the transistors 29 and 30, and 31 and 32 respectively constituting a current buffer, and applied to the piezoelectric vibrators 8, 8 (FIG. 2).

In a thus configured driving signal generating circuit applied to a pull-dotting system ink jet recording head, if a charge signal $P_c$ is applied to the terminal $IN_1$ at the time T1 synchronously with a print timing signal a constant current flows into the piezoelectric vibrator 8, and the terminal voltage (FIG. 4D) of the piezoelectric vibrator 8 increases at a constant rate. The vibration plate 5 contracts at a constant rate correspondingly so as to be displaced downward in FIG. 2. The volumes of the pressure generating chambers 15, 15 are expanded correspondingly and negative pressure is generated in the pressure generating chambers 15, 15 so that the ink in the reservoirs 17, 17 flows into the pressure generating chambers 15, 15 through the ink supply ports 16, 16, and at the same time the menisci of the nozzle openings 2, 2 are pulled into the pressure generating chambers 15, 15.

The menisci move toward the nozzle openings because of surface tension after they are pulled into the pressure generating chambers 15, 15 to some extent (FIG. 4E).

At a point of time ($T_2$) when the time corresponding to the pulse width $P_{wc}$ of the charge signal $P_c$ has passed and charging the piezoelectric vibrator 8 has been finished, the terminal voltage of the piezoelectric vibrator 8 is in a so called hold state where it is held at the power source voltage $V_0$. Therefore, if a discharge signal $P_d$ is applied at a point of time ($T_3$) when a given hold time $P_{wh}$ has passed, the charges of the piezoelectric vibrator 8 are discharged at a constant rate so that its terminal voltage is decreased at a constant rate (FIG. 4D). Thus the pressure generating chambers 15, 15 contract to eject ink as ink drops from the nozzle openings.

The charges of the piezoelectric vibrator 8 are perfectly discharged at a point of time ($T_4$) when the drops of ink are ejected and the time corresponding to the pulse width $P_{wd}$ of the discharge signal has passed.

On the other hand, the meniscus is formed in the pressure generating chamber 15 because ink corresponding to the volume of the ink drop is discharged from the pressure generating chamber 15, and the meniscus produces residual vibrations with an inherent vibration period depending on the physical properties of the ink, the size of the pressure generating chamber 15, and the size of the member constituting the pressure generating chamber 15. Therefore, as shown in FIG. 4E, the meniscus repeats movement toward the outside of the nozzle opening or toward the pressure generating chamber side.

In order to prevent the influence of such vibration of the meniscus, time $P_{wt}$, which is necessary to attenuate the vibration to a sufficient extent not to give any influence to the formation of a dot, is established, or the pulse width $P_{wc}$ of the charge signal $P_c$ and the hold time $P_{wh}$ are elongated to a sufficient degree.

However, the speed of printing is reduced if such a pause period $P_{wt}$ is established or the charge pulse width $P_{wc}$ and the hold time $P_{wh}$ are elongated. Alternatively, the position of the meniscus at the time of ejection can be changed with a driving frequency if typing is performed at a high speed. In this case, unlike the above- mentioned case in which the meniscus is in a stationary state, the position of the meniscus at the time of output of a print timing signal is, for example, in the pressure generation chamber side, so that there occurs a new problem that the quality of printing varies depending on the frequency.

That is, if a print timing signal is outputted when the meniscus, which vibrates due to the residual vibration of the piezoelectric vibrator, moves toward the nozzle opening, negative pressure caused by the expansion of the pressure generating chamber 15 produces a force to move the meniscus toward the pressure generating chamber. Such a force is however canceled by the force of the meniscus per se to move to the outside of the nozzle opening due to the above-mentioned residual vibration. The result is that the influence of the negative pressure is reduced as much as possible, and the meniscus is returned to the nozzle opening side at once. If, then, the charges of the piezoelectric vibrator are discharged at a constant rate so that the piezoelectric vibrator expands, an ink drop is formed in such a state that the meniscus is positioned in the nozzle opening side as much as possible. Accordingly, it is possible to obtain a necessary volume of the ink drop. The flying speed, however, generally becomes low.

Conversely, if a print timing signal is outputted when the meniscus, which vibrates due to the residual vibration, is moving toward the pressure generating chamber, the movement of the meniscus caused by the residual vibration falls on the movement of the meniscus toward the pressure generating chamber caused by the negative pressure produced by the expansion of the pressure generating chamber, so that the meniscus moves deeply into the pressure generating chamber and the return of the meniscus toward the nozzle opening is delayed. If, then, the charges of the piezoelectric vibrator are discharged at a constant rate so that the piezoelectric vibrator expands, an ink drop is formed while the meniscus is drawn into the pressure generating chamber away from the nozzle opening and the ink drop is rendered small in volume even though the flying speed becomes high.

Thus the size and speed of the formed ink drop vary greatly depending on the position of the meniscus, even if the piezoelectric vibrator is driven with the same energy. As a result, dots formed on a recording medium vary in size so that the printing quality is lowered.

Also, in such a configuration in which the pressure in the pressure generating chambers is changed correspondingly to the print timing signals, vibrations from mechanical structures of the pressure generating chambers per se and hydrodynamic vibrations of ink per se are generated, thereby causing vibrations of menisci in the vicinity of the respective nozzle openings such that the menisci reciprocate between the nozzle openings and the respective pressure generating chambers after formation of ink drops.

As a result, even if the same pressure change is generated in each pressure generating chamber, the ejected ink drop varies in its size and flying speed depending on the positional relationship between the associated nozzle opening and the meniscus formed in the vicinity of the nozzle opening, resulting in a problem that variations are caused in printing quality.

In order to solve such a problem, it is possible to consider a technique whereby successive ink drop formation is performed only after the vibration of the meniscus, caused after the formation of the preceding ink drop, is reduced to such an extent as to have no influence on the printing quality. This technique however has a problem in that the printing speed is greatly reduced due to the waiting time needed until the vibration of the meniscus is suppressed.

SUMMARY OF THE INVENTION

The present invention was made in view of the aforementioned problems accompanying the conventional apparatus.

Therefore, an object of the present invention is to provide a novel ink jet type recording apparatus in which an ink drop is formed normally when the meniscus comes into a predetermined state independently of the vibration of the pressure generating chamber and the hydrodynamic vibration of ink per se.

Another object of the invention is to provide an ink jet type recording head having a driving circuit capable of forming consistent ink drops at rapid repetition rate.

The above and other objects can be accomplished by a provision of an ink-jet type recording apparatus having an ink jet recording head which, according to the present invention, includes a pressure generating chamber communicating with a nozzle opening and a piezoelectric vibrator for pressurizing the pressure generation chamber; a driving signal generating means for generating a first voltage waveform for expanding the piezoelectric vibrator at a rate suitable to form an ink drop, a second voltage for keeping the piezoelectric vibrator in its expanded or contracted state, and a third voltage waveform for contracting the piezoelectric vibrator at a rate suitable to suck ink into the pressure generating chamber; an ink drop formation completion time detecting means for detecting a point of time at which an ink drop forming process by the first voltage waveform is completed; a delay means for delaying a signal from the ink drop formation completion time detecting means by a time $\Delta T$ until a vibration of a meniscus generated in the ink drop forming process is switched into a movement toward the nozzle opening; a pressure generating chamber expanding signal generating means for generating the third voltage waveform in response to a signal from the delay means; and a pressure generating chamber contracting signal generating means for generating the first voltage waveform in response to a print timing signal.

Since ink necessary for forming a succeeding ink drop is sucked into the pressure generating chamber at a point of time when the meniscus formed after formation of a preceding ink drop begins to move to the nozzle opening side, the force moving the meniscus back at this time is canceled by the movement of the meniscus per se. As a result, the retreat of the meniscus due to the suction of the ink into the pressure generating chamber can be suppressed to the minimum and the meniscus can be reliably positioned stably in the vicinity of the nozzle opening at the time of ink ejection, independently of the value of the driving frequency.

BRIEF DESCRIPTION OF THE DRAWINGS

FIGS. 4A–4E are explanatory diagrams illustrating conventional print timing in a conventional ink jet recording apparatus.

DESCRIPTION OF THE PREFERRED EMBODIMENTS

Figure 1:
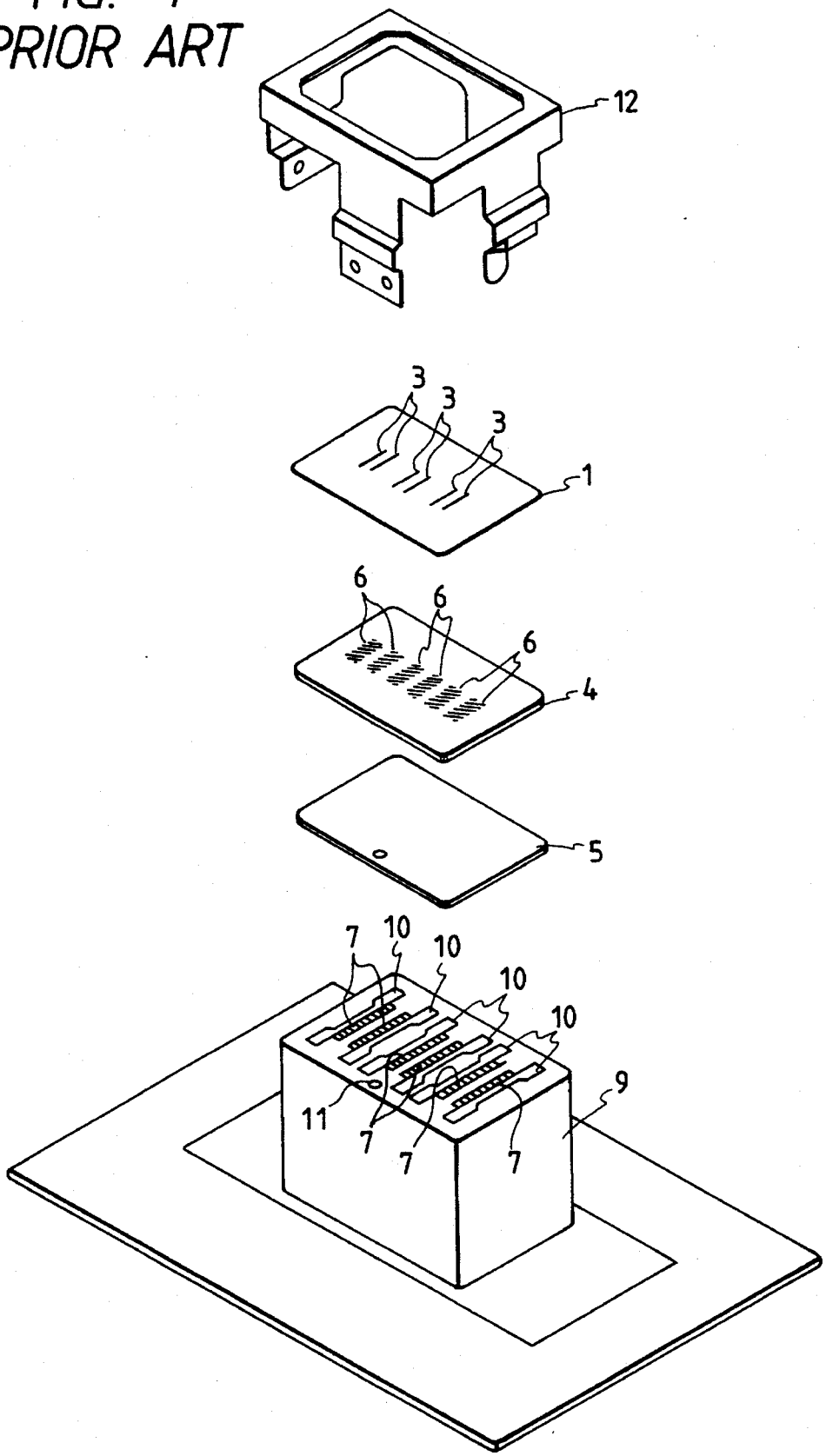
FIG. 1 PRIOR ART
FIG. 1 is an exploded perspective view illustrating a known ink jet type recording head to which a driving circuit according to the present invention can be applied.

The present invention will be described in detail with respect to its embodiments illustrated in the drawings.

Figure 5:
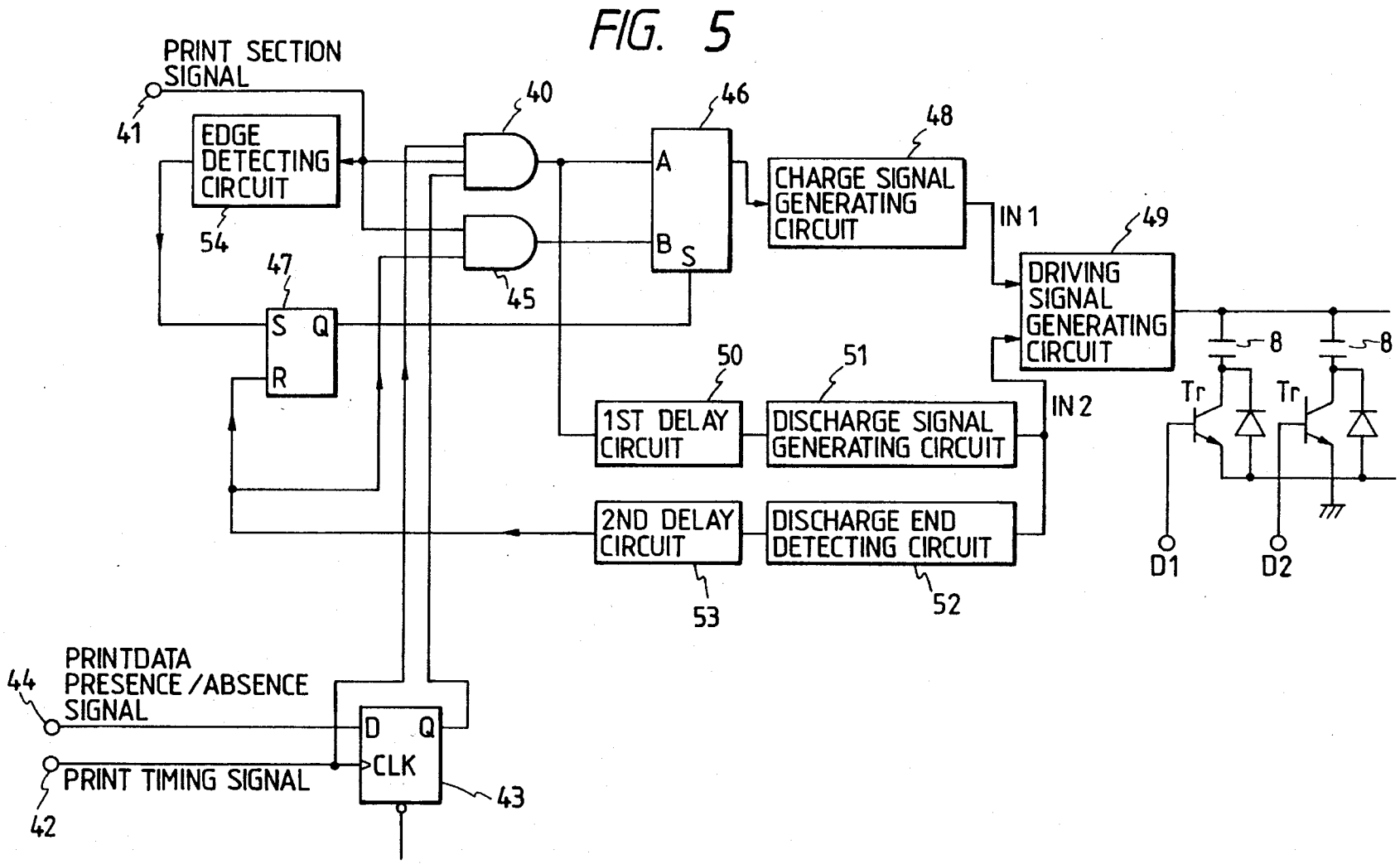
FIG. 5 is a constituent diagram illustrating a first embodiment of the present invention.

FIG. 5 shows an embodiment of a driving circuit according to the present invention, by which it is possible to improve the printing speed without inducing the deterioration of printing quality, by making positive use of the vibration of the meniscus caused by such a residual vibration. In FIG. 5, the reference numeral 43 represents a first stage shift register which outputs a print data presence/absence signal indicating the presence/absence of print data supplied to a terminal 44, in synchronism with a print timing signal which is produced every time a recording head traverses a unit distance and which is supplied from a terminal 42. This print data presence/absence signal indicates the presence/absence of print data in the case of driving at least one of a plurality of piezoelectric vibrators 8, 8 connected to a driving signal generating circuit 49 which will be described later. The output of this shift register 43 and the print timing signal are supplied into a first AND gate 40, and a print section signal from a terminal 41, that is, a signal indicating that the recording head is traversing an area to be printed, is further supplied to the first AND gate 40. Thus the first AND gate 40 outputs a signal corresponding to the print timing signal if there is print data.

The print section signal of the terminal 41 is also supplied to a second AND gate 45, and further supplied to a flip flop 47 through an edge detecting circuit 54. The edge detecting circuit 54 detects the point of time when the print section signal is outputted, that is, the point of time when the recording head enters the area to be printed, and then the edge detecting circuit 54 sets the flip flop 47. The output of the flip flop 47 is supplied to a terminal S of a selector 46 which selects one of the output of the first AND gate 40 if the terminal S is in an H level and the output of the second AND gate 45 if S is in an L level. The selector 46 supplies a charge trigger signal to a charge signal generating circuit 48 which acts as means for generating a pressure generating chamber expanding signal.

Figure 3:
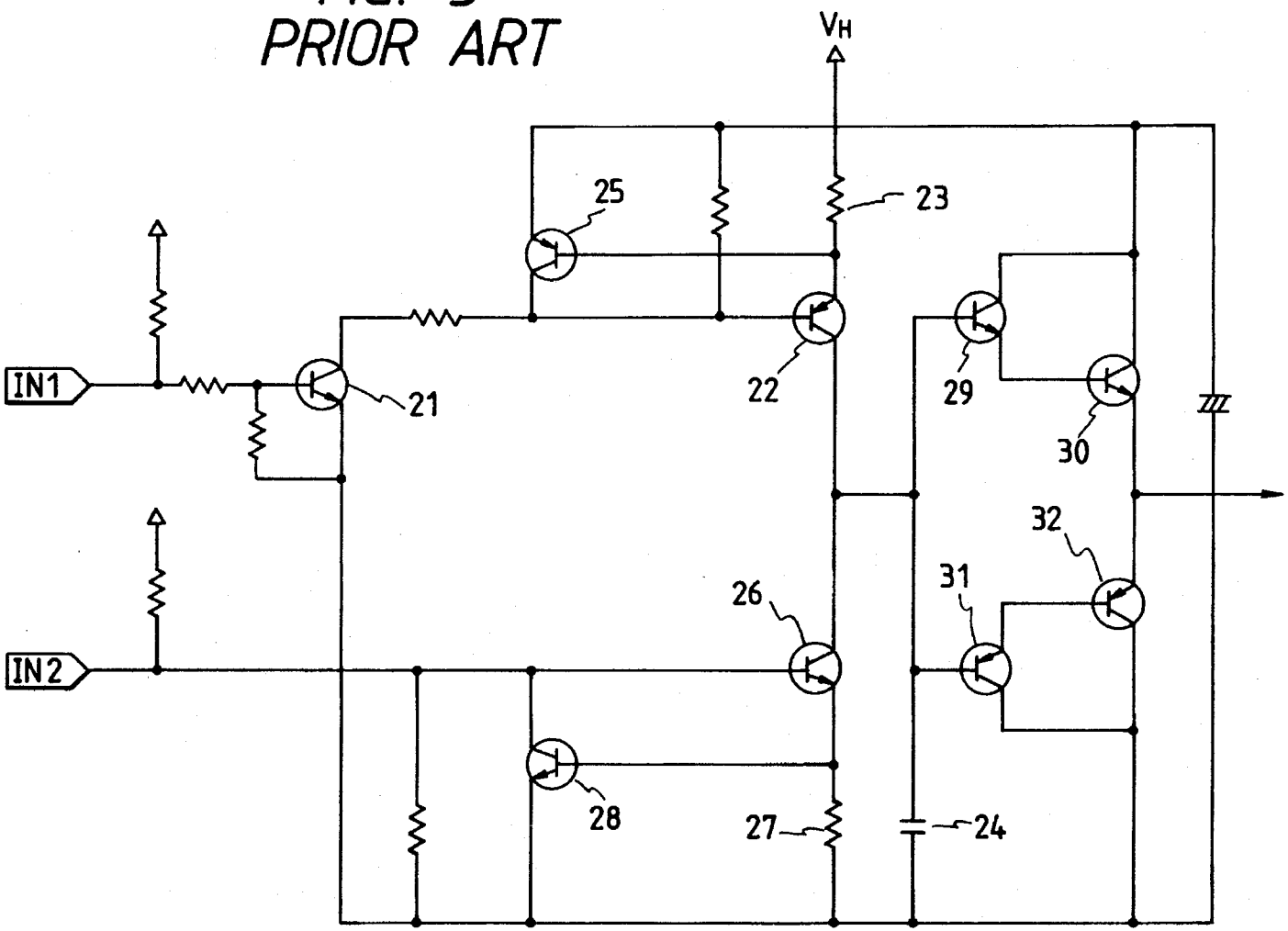
FIG. 3 PRIOR ART
FIG. 3 is a circuit diagram illustrating an example of a conventional driving circuit for generating a trapezoid driving signal used to drive an on-demand type ink jet recording head.
Figures 4B, 4C:
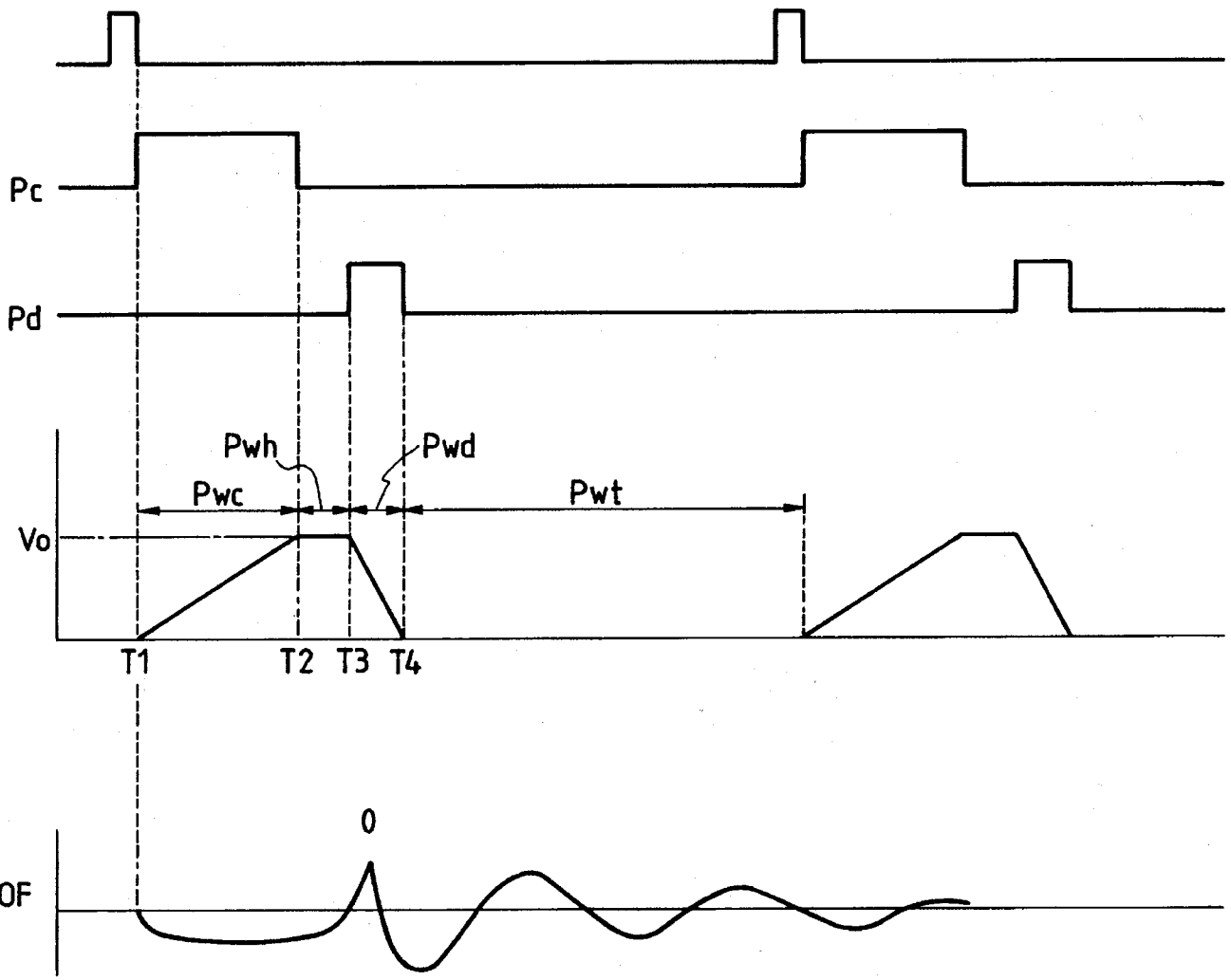
FIG. 4B PRIOR ART
FIG. 4C PRIOR ART

The charge signal generating circuit 48 is actuated to operate by the charge trigger signal from the selector 46 so as to supply a charge signal $P_c$ of a pulse width of $P_{wc}$ to a terminal $IN_1$ of the driving signal generating circuit 49 having the same structure as that shown in FIG. 3.

The reference numeral 50 represents a first delay circuit which delays the output of the first AND gate 40 in accordance with the above-mentioned print timing signal by a predetermined time ($P_{wc}$+$P_{wh}$) to form a discharge trigger signal which is in turn supplied to a discharge signal generating circuit 51 which acts as means for generating a pressure generating chamber contracting signal. The discharge signal generating circuit 51 is actuated to operate by the discharge trigger signal from the first delay circuit 50, so as to supply a discharge signal $P_d$ of a pulse width $P_{wd}$, which is enough to eject an ink drop to a terminal $IN_2$ of the driving signal generating circuit 49.

The reference numeral 52 represents a discharge end detecting circuit which acts as means for detecting the end time of the formation of an ink drop, which circuit detects the time of the trailing edge of the discharge signal $P_d$, and outputs a signal in response to the end of the discharge, that is, the end time of the ejection of an ink drop, which signal is supplied to a reset terminal R of the flip flop 47 through a second delay circuit 53, and is also supplied to the second AND gate 45, to function as the next trigger signal.

The delay time of the second delay circuit 53 is set to the time delayed by a time ΔT from the end time of discharge, so that the next charge trigger signal is supplied from the second AND gate 45 when the vibration of a meniscus caused by the ejection of an ink drop from a nozzle opening begins to move toward the nozzle opening after the discharge is ended, that is, after the ejection is finished. The reference signs $T_r$ , $T_r$ in the drawing represent transistors which are turned on by respective print data supplied to respective terminals $D_1$, $D_2$ in synchronism with a print timing signal to apply the output of the driving signal generating circuit 49 to piezoelectric vibrators 8, 8 . . . destined for printing.

Next, the operation of the thus configured apparatus will be described with reference to the timing diagram shown in FIG. 6.

If an instruction to perform printing on a given area is supplied to a printer from a host computer, an instruction to move a recording head toward the area to be printed is given from a control portion (not shown) so that the recording head starts to move to the area to be printed. If the recording head reaches the position where printing is to be started, a print section signal is supplied to the terminal 41. The flip flop 47 is set by this print section signal so that the terminal S of the selector 46 is brought into an H level. Consequently, the output of the first AND gate 40 is selected as a charge trigger signal to actuate the charge signal generating circuit 48 to operate.

Figures 6A, 6B, 6C, 6D, 6E, 6F:
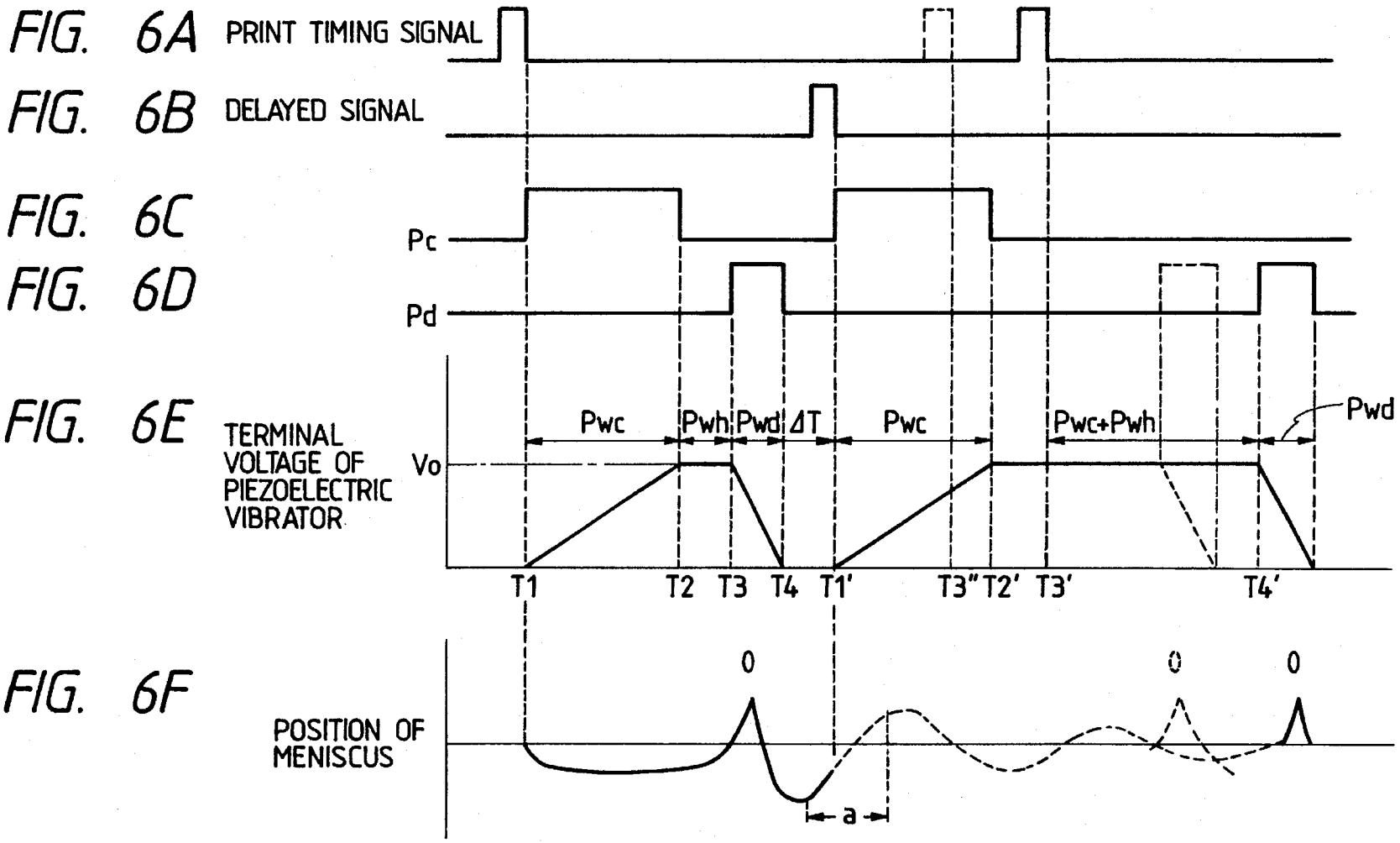
FIGS. 6A–6F are diagrams illustrating the operation of the apparatus shown in FIG. 5 with respect to print timing.

At the time of printing the first dot, if a charge trigger signal from the first AND gate 40 is supplied to the charge signal generating circuit 48 through the selector 46 in accordance with a print timing signal (FIG. 6A) of the terminal 42, a charge signal $P_c$ (FIG. 6C) of a pulse width $P_{wc}$ is supplied to the terminal $IN_1$ of the driving signal generating circuit 49 from the charge signal generating circuit 48 in response the charge trigger signal. Thus the driving signal generating circuit 49 outputs a charge voltage signal with a constant inclination from a point of time $T_1$ (FIG. 6E). Though this charge voltage signal is supplied to each piezoelectric vibrator 8, the other terminal of each piezoelectric vibrator 8 is connected to its associated transistor $T_r$, and print data for forming dots are supplied to the terminals $D_1$, $D_2$ . . . in advance, so that only those connected to the turned-on $T_r$ are charged selectively.

The charged piezoelectric vibrator 8 contracts at a constant rate to expand the pressure generating chamber 15 at a constant rate as mentioned above. Thus enough charging is completed up to the power source voltage $V_0$ in the stage ($T_2$) in which the time corresponding to the pulse width $P_{wc}$ of the charge signal $P_c$ has passed, and this voltage $V_0$ is held thereafter.

The first delay circuit 50 supplies a discharge trigger signal to the discharge signal generating circuit 51 in the stage ($T_3$) in which the time defined by the first delay circuit 50 has passed from the point of time when the charge trigger signal is supplied from the first AND gate 40. The discharge signal generating circuit 51 supplies a discharge signal $P_d$ (FIG. 6D) having a pulse width $P_{wd}$ to the terminal $IN_2$ of the driving signal generating circuit 49 in response to this discharge trigger signal. Consequently, the driving signal generating circuit 49 generates a discharge voltage signal with a constant inclination by which the charges accumulated in the piezoelectric vibrator 8 are discharged at a constant rate so that the piezoelectric vibrator 8 expands at a constant rate (FIG. 6E). The pressure generating chamber 15 contracts in accordance with the expansion of the piezoelectric vibrator 8 so that an ink drop is ejected from the nozzle opening 2.

At a point of time ($T_4$) when the time defined by the pulse width of the discharge signal $P_d$ has passed, the discharge end detecting circuit 52 detects the trailing edge of the discharge signal and outputs a signal. This output signal is delayed by a predetermined time ΔT by the second delay circuit 53 (FIG. 6B), and supplied to the reset terminal R of the flip flop 47 to reset the latter so that the terminal S of the selector 46 is brought into an L level to make the selector 46 select the output of the second AND gate 45 thereafter.

The output signal of the second delay circuit 53 also supplied to the second AND gate 45 at the same time is supplied to the charge signal generating circuit 48 which is used as a charge trigger signal as it is. Consequently, a charge signal $P_c$ (FIG. 6C) is outputted from the charge signal generating circuit 48 at a point of time $T_1'$ in the range during which the meniscus is moving toward the nozzle opening (the area referenced by the sign a in FIG. 6).

At a point of time when the piezoelectric vibrator 8 starts to contract in response to this charge signal $P_c$, as shown in FIG. 6F, the meniscus is vibrating due to the previous formation of an ink drop, and the meniscus is moving toward the nozzle opening 2 from the pressure generating chamber 15, so that if the pressure generating chamber 15 is expanded by the charge signal $P_c$ at this time, the force to retreat the meniscus due to this expansion is canceled by the force for the meniscus to move toward the nozzle opening after the above ejection of ink. Therefore, the quantity of the retreat of the meniscus caused by the expansion of the pressure generating chamber 15 becomes so small as to return to the nozzle opening quickly. That is, this means that it is possible to shorten the duration between charge signals $P_c$. The piezoelectric vibrator 8 is charged enough up to the power source voltage $V_0$ and is in the hold state at a point of time ($T_2'$) when the time corresponding to the pulse width $P_{wc}$ of the charge signal $P_c$ has passed.

Thereafter, if print data exist at a point of time ($T_3'$) when a print timing signal is inputted, a discharge signal $P_d$ is outputted at a point of time $T_4'$ when the time defined by the first delay circuit 50 has passed, so that the piezoelectric vibrator 8 is expanded to compress the pressure generating chamber 15 to thereby eject an ink drop. Since the process of expanding the pressure generating chamber 15 is completed at the point of time $T_2'$, it is possible to eject an ink drop if a print timing signal is inputted in the stage ($T_3''$) before an illustrated normal print timing signal is inputted.

Although this ejection of an ink drop causes the vibration of the meniscus in the nozzle as mentioned above, a signal is supplied from the second delay circuit 53 to the second AND gate 45 again when the time ΔT has passed from the end time of outputting a discharge signal $P_d$, and a charge signal $P_c$ is supplied to the charge signal generating circuit 48 through the selector 46 from the second AND gate 45, so that the process of expanding the pressure generating chamber 15 is executed within the area a shown in FIG. 6 in which the meniscus is moving toward the nozzle opening.

That is, unlike the conventional case where the pressure generating chamber 15 is expanded at the timing of the succeeding print timing signal after formation an ink drop, the time to start the operation for expanding the pressure generating chamber 15 is defined on the basis of the end time of the previous operation of forming an ink drop according to the present invention as described above, so that the pressure generating chamber 15 can be expanded when the meniscus caused by the preceding formation of an ink drop is moving toward the nozzle opening. Accordingly, the force to retreat the meniscus caused by the expansion of the pressure generating chamber 15 can be canceled by the motion of the meniscus per se. Even if the pulse width $P_{wc}$ is short, therefore, it is possible to expand the piezoelectric vibrator 8 to eject an ink drop in the state that the meniscus has been returned to the nozzle top. Further, the position of the meniscus can be made constant at the time of the ejection independently of the driving frequency.

Figure 2:
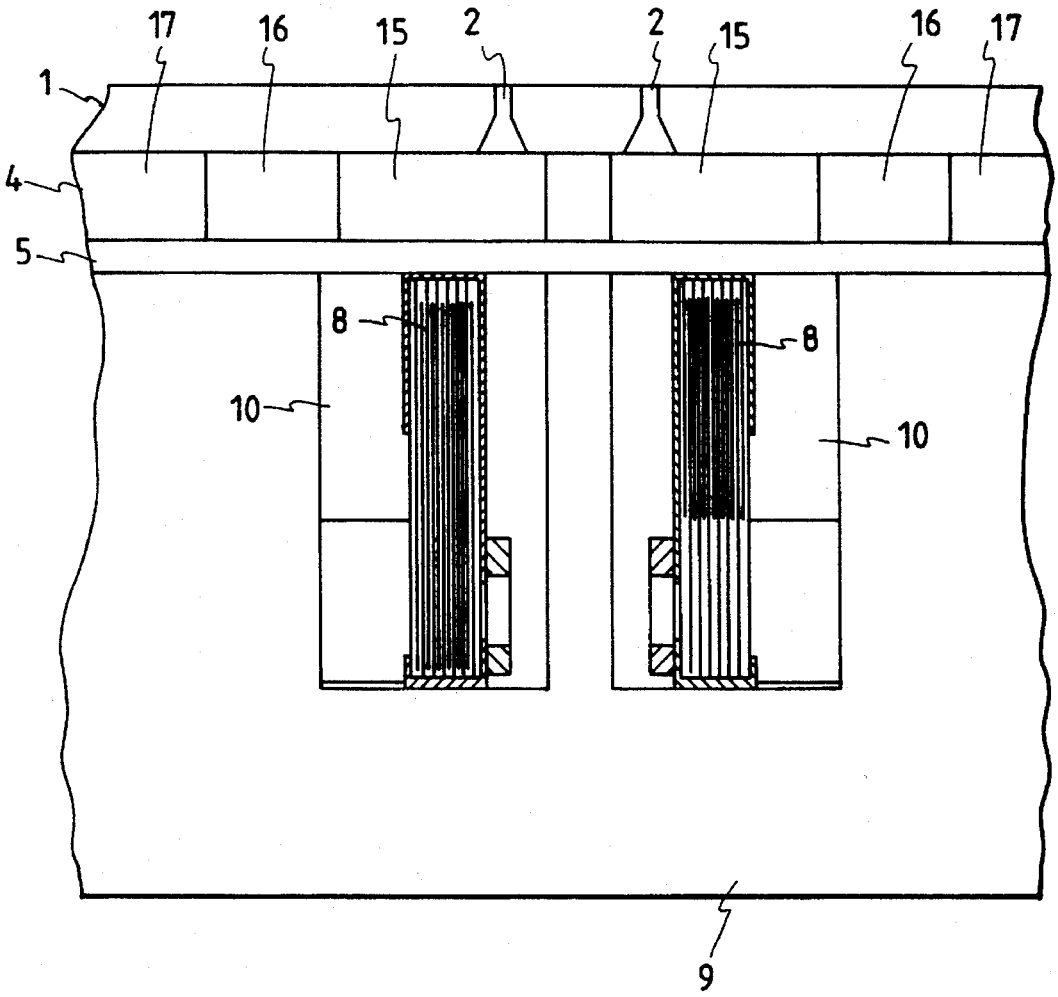
FIG. 2 PRIOR ART
FIG. 2 is an enlarged sectional view illustrating the neighborhood of pressure generating chambers in the apparatus shown in FIG. 1.

The driving circuit of the present invention can be applied to the known ink-jet type print head as shown in FIGS. 1 and 2.

Figure 7:
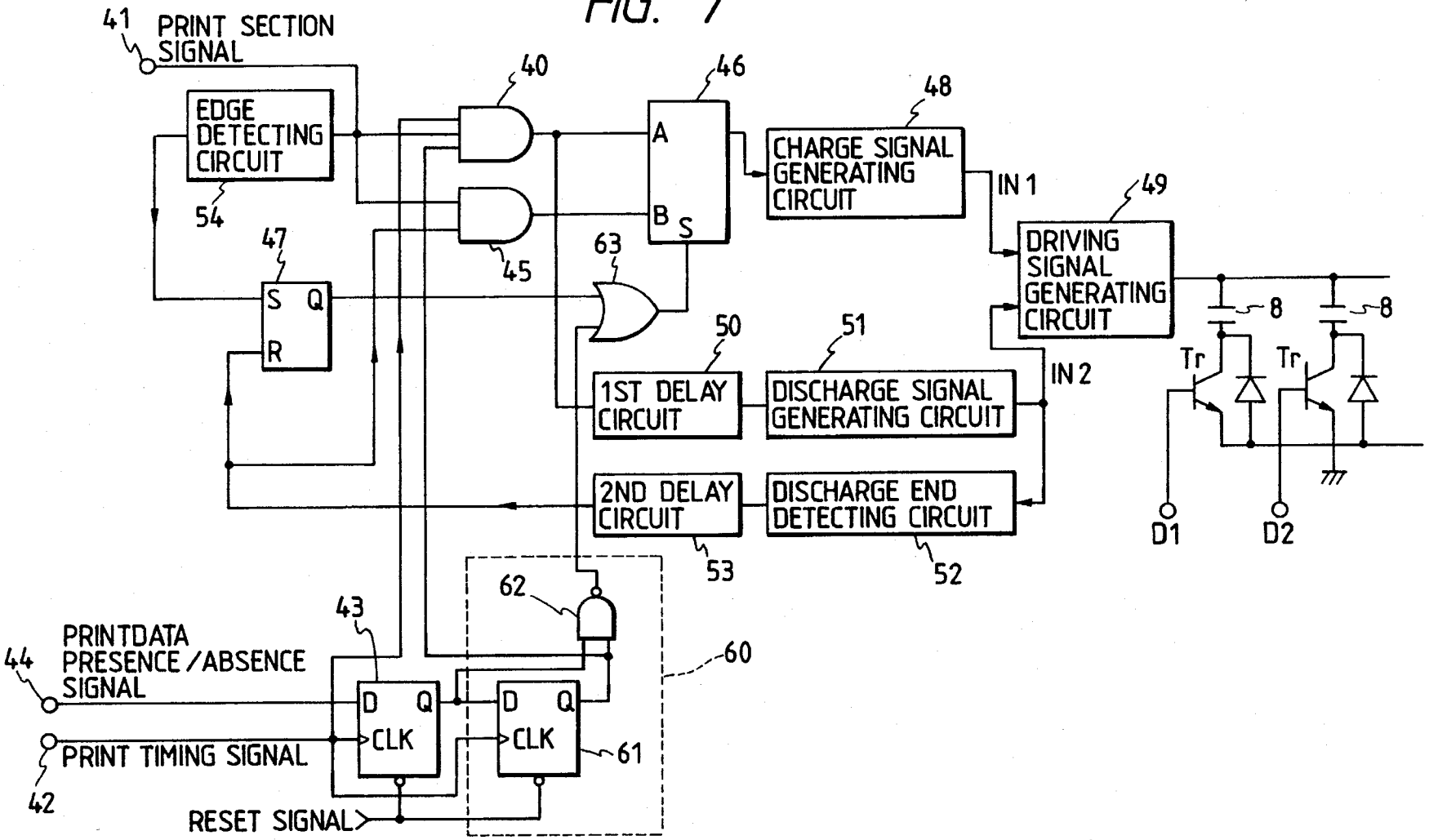
FIG. 7 is an arrangement diagram illustrating a second embodiment of the present invention.

FIG. 7 shows a second embodiment of the present invention. In FIG. 7, the reference numeral 60 represents a print data monitoring means constituted by a second stage shift register 61 connected in cascade to the above-mentioned shift register 43, and a NAND gate 62 for detecting whether there are signals in all those shift registers 43 and 61 or not, so that the means 60 outputs an L signal only in the case where there are a plurality of continuous print data, two continuous dots in this embodiment. The signal from this print data monitoring means 60 is supplied to the terminal S of the selector 46 through an OR gate 63 together with a signal from the above-mentioned flip flop 47.

If the recording head starts moving for performing printing and reaches the position which is immediately before the area to be printed, a print data presence/absence signal stats to be supplied to the terminal 44, and a matter to be recorded in the first recording position is stored in the shift register 43 in synchronism with a print timing signal. In the next print timing, that is, in the stage in which the recording head has reached the area to be printed, a print data presence/absence signal aimed in the present print timing is stored in the shift register 61, and another print data presence/absence signal aimed in the next print timing is stored in the shift register 43.

The current and succeeding print data presence/absence signals are stored in the print data monitoring means 60 in the print area in such a manner, and the print data means 60 supplies these two signals to the NAND gate 62 so as to judge whether there are continuous dots to be formed or not.

An L level signal is supplied from the NAND gate 62 to the OR gate 63 only when there are continuous dots to be formed. In this case, the terminal S of the selector 46 becomes coincident with the output signal level of the flip flop 47 to perform the operation similar to the embodiment shown in FIG. 5. That is, a charge trigger signal is supplied to the charge signal generating circuit 48 when the time (ΔT) required for the meniscus caused by the previous formation of an ink drop to move toward the nozzle opening has passed from the end time of the operation of the ink drop formation. Although a signal is also supplied from the first AND gate 40 in such a case of continuous dots to be printed, a signal from the second gate 45 is selected by the selector 46 in advance in such a case of continuous dots to be printed, so that the charge signal generating circuit 48 operates on the basis of the ink drop ejecting operation immediately before.

Figure 8:
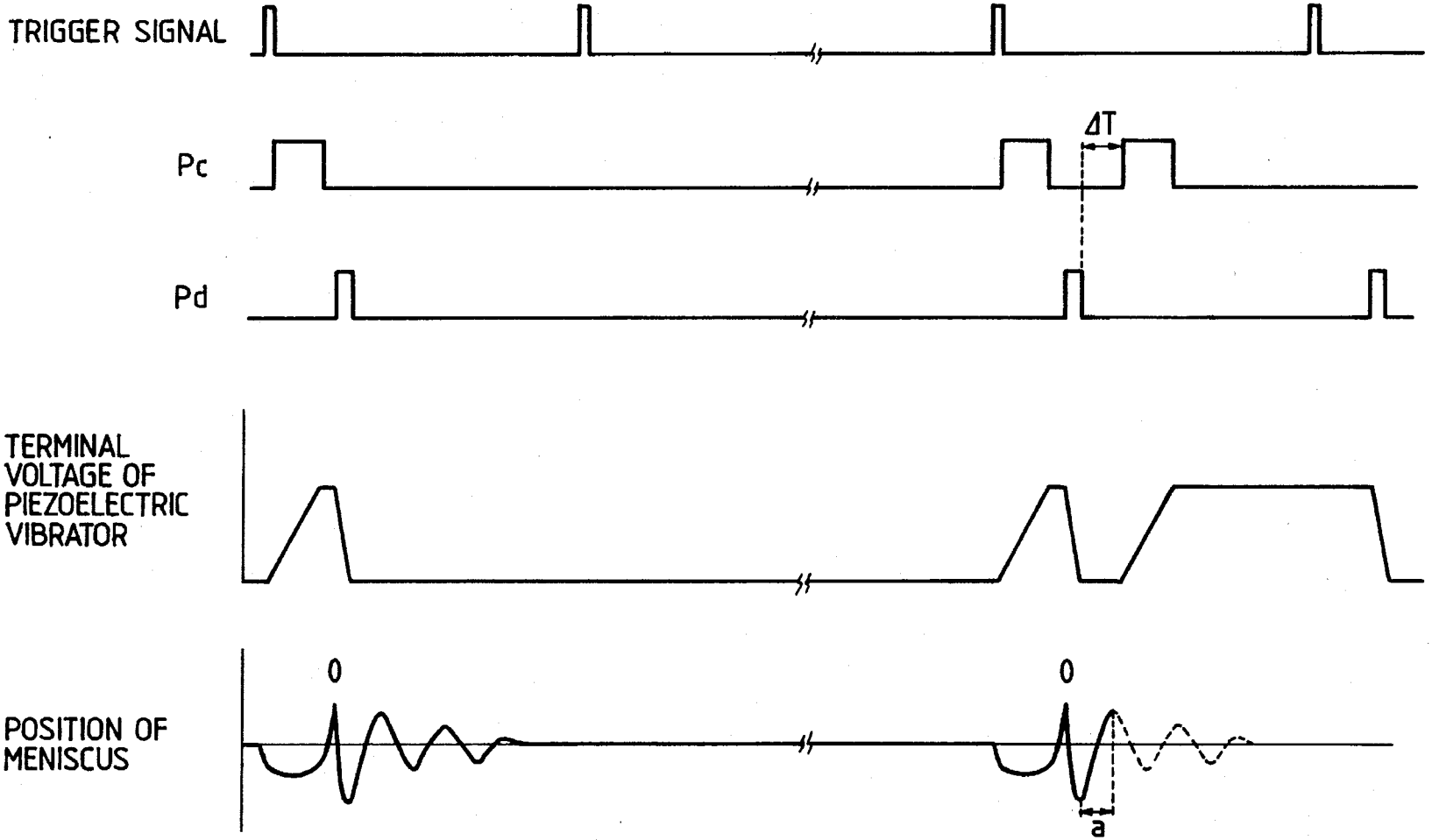
FIG. 8 is a diagram illustrating the operation of the apparatus shown in FIG. 7 with respect to print timing.

On the other hand, if there are no continuous dots to be formed, the NAND gate 62 supplies an H level signal to the OR gate 63. In this case, since the terminal S of the selector 46 is brought into an H level, the output from the first AND gate 40 is selected as a charge trigger signal. That is, if the next print timing has no dot to be printed, a charge trigger signal is prevented from being outputted until there occurs a print timing having a dot to be printed, as in the conventional case. As a result, in the case where blanks continue over a plurality of bits so that it is not necessary to eject ink, the piezoelectric vibrators 8, 8 are kept in the no-voltage state as shown in FIG. 8, so that no unnecessary voltage is applied to the piezoelectric vibrators 8, 8 and it is possible to elongate the life time of the piezoelectric vibrators 8, 8.

Since the piezoelectric vibrators 8, 8 are put in the pause state over several continuous bits, when a charge signal is thereafter applied to form a dot, the operation of printing is started in such a state that the meniscus has settled into a stationary state, so that there is no fear that the quality of the printing is lowered, and there is no fear that the printing speed is reduced.

Figure 9:
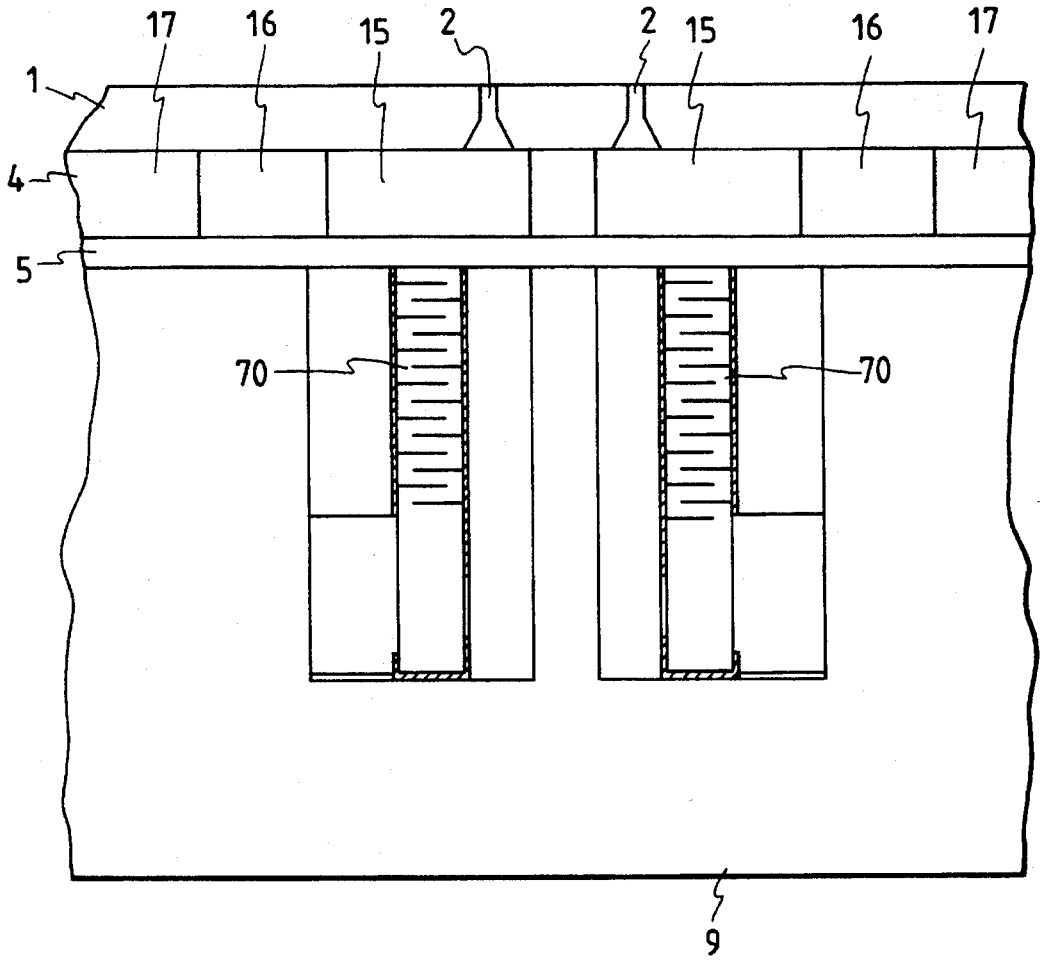
FIG. 9 is a sectional view illustrating an example of a push-dotting system ink jet recording head to which the present invention can be applied.

Although in the above embodiments the operation of forming an ink drop was described in connection with an example of the system in which pressure generating chambers are first expanded, and next contracted, similarly to this, the present invention can be applied also to a recording head using d33-type piezoelectric vibrators 70, 70 which have, as shown in FIG. 9, electrodes arranged in the direction of expansion and contraction so as to expand by charge and contract by discharge.

Figures 10A, 10B, 10C, 10D, 10E, 10F:
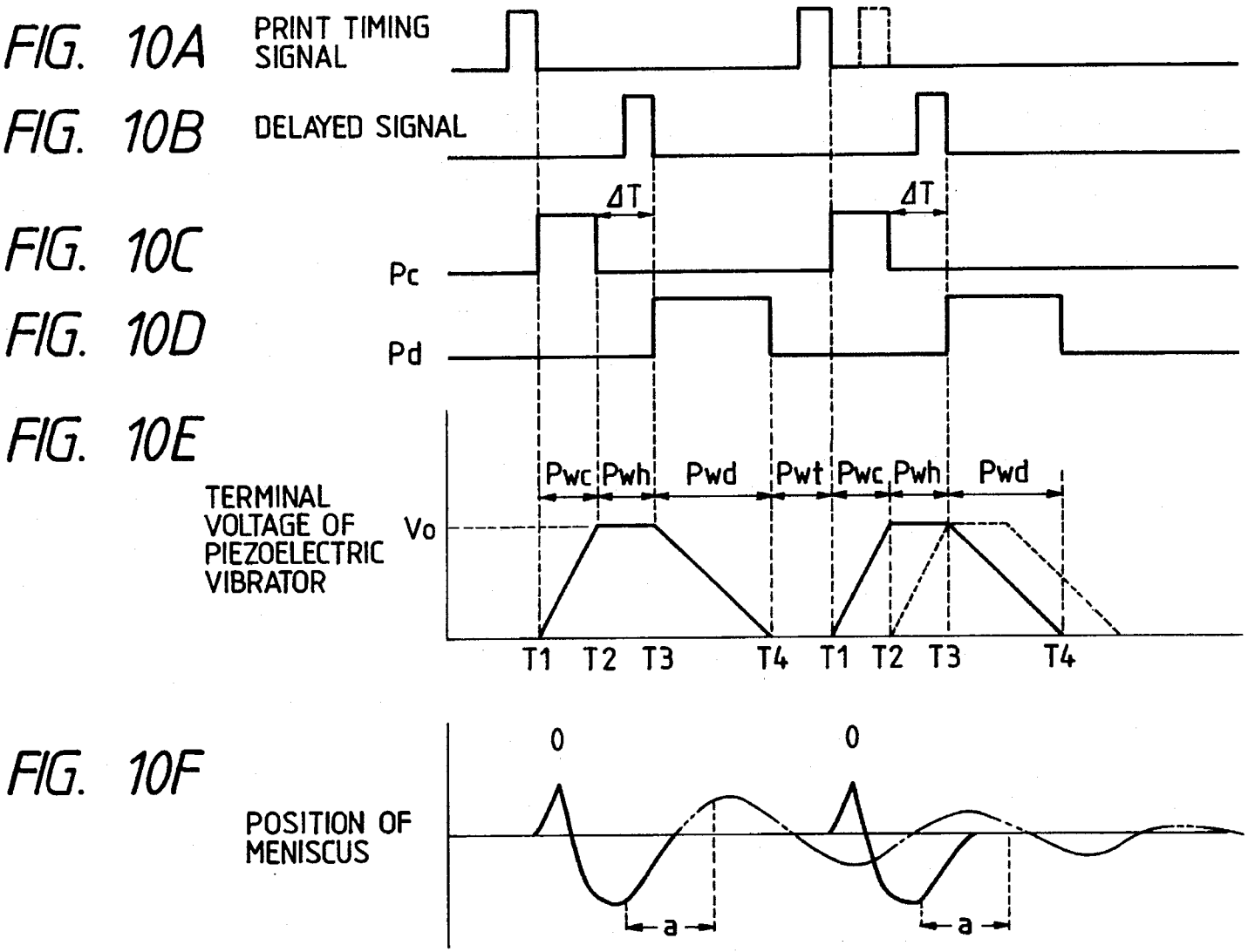
FIGS. 10A–10F are diagrams illustrating a third embodiment of the present invention with respect to print timing.

That is, the pulse width $P_{wc}$ (FIG. 10E) of the charge signal $P_c$ (FIG. 10C) is set to a sufficient time to form an ink drop, and the hold time $P_{wh}$ (FIG. 10E) is set to the time ΔT (FIG. 10B, 10C) when the expansion of the pressure generating chamber can be started in the area in which the meniscus moves toward the nozzle opening after the formation of an ink drop, and the pulse width of the discharge signal $P_d$ (FIG. 10D) is set to $P_{wd}$ (FIG. 10E), respectively in advance.

If an ink drop was formed immediately before, the end time $T_2$ (FIG. 10E) of forming the ink drop is detected by means equivalent to the above-mentioned discharge end detecting circuit 52, and a discharge signal generating means is started up after a constant time from this time, that is, through a signal delay means which can set the time $\Delta T$ (FIG. 10B, 10C) to lie within an area a (FIG. 10F) in which the vibration of the meniscus caused by the formation of the ink drop is moving toward the nozzle opening.

As a result, the piezoelectric vibrator is held in a constant voltage $V_0$ (FIG. 10E) and held in the expansion state after the formation of the ink drop, and the piezoelectric vibrator discharges its charges at any point of time ($T_3$) in the area a (FIG. 10F) in which the meniscus is moving toward the nozzle opening. Therefore, since the process of expanding the pressure generating chamber 15 is started in the stage in which the meniscus is moving toward the nozzle opening, the meniscus can be always positioned near the nozzle top at the time of ejecting an ink drop in the same manner as in the above-mentioned recording head.

As has been described, according to the present invention, the ink-jet type recording apparatus comprises: an ink jet recording head including a pressure generating chamber communicating with a nozzle opening and a piezoelectric vibrator for pressurizing the pressure generation chamber; a driving signal generating means for generating a first voltage waveform for expanding the piezoelectric vibrator at a rate suitable to form an ink drop, a second voltage waveform for keeping the piezoelectric vibrator in its expanded or contracted state, and a third voltage waveform for contracting the piezoelectric vibrator at a rate suitable to suck ink into the pressure generating chamber; an ink drop formation completion time detecting means for detecting a point of time at which an ink drop forming process by the first voltage waveform is completed; a delay means for delaying a signal from the ink drop formation completion time detecting means by a time $\Delta T$ until a vibration of a meniscus generated in the ink drop forming process is switched into a movement toward the nozzle opening; a pressure generating chamber expanding signal generating means for generating the third voltage waveform in response to a signal from the delay means; and a pressure generating chamber contracting signal generating means for generating the first voltage waveform in response to a print timing signal. Accordingly, the pressure generating chambers contract in the area in which the menisci are moving toward the nozzle openings after the ink drop ejection, so that the menisci at the time of ink drop ejection can be positioned near the nozzle tops as much as possible. Accordingly, it is possible to improve the printing speed, and it is possible to prevent the quality of printing from being changed depending on the driving frequency.

What is claimed is:

1. An ink jet type recording apparatus comprising:

an ink jet recording head comprising an ink reservoir having a supply port, said ink reservoir containing an ink, and a pressure generating chamber communicating with a nozzle opening and a piezoelectric vibrator for pressurizing said pressure generating chamber, said pressure generating chamber receiving the ink from said supply port the ink having a meniscus directed toward said nozzle opening;

a driving signal generating means for generating a first voltage waveform for expanding said piezoelectric vibrator at a rate suitable to form an ink drop, a second voltage for keeping said piezoelectric vibrator in an expanded state, and a third voltage waveform for contracting said piezoelectric vibrator at a rate suitable to suck ink into said pressure generating chamber;

an ink drop formation completion time detecting means for detecting a point in time at which an ink drop forming process by said first voltage waveform is completed, and outputting a detecting signal indicative of the point in time;

a delay means for delaying the detecting signal from said ink drop formation completion time detecting means by a time $\Delta T$ until a vibration of the meniscus generated in said ink drop forming process is switched into a movement toward said nozzle opening;

a pressure generating chamber expanding signal generating means for triggering said driving signal generating means to generate the third voltage waveform in response to the delayed signal from said delay means; and a pressure generating chamber contracting signal generating means for triggering said driving signal generating means to generate the first voltage waveform in response to a print timing signal.

2. An ink jet type recording apparatus according to claim 1, wherein said pressure generating chamber expanding signal generating means is actuated to respond to the delayed signal by means of the print timing signal at a start of printing.

3. An ink jet type recording apparatus according to claim 1, further comprising a switching means for selecting between the delayed signal from said delay means and the print timing signal, and means for judging whether data to be printed exist continuously or not to thereby actuate said switching means to operate, whereby when the data to be printed is continuous said pressure generating chamber expanding signal generating means is actuated to operate via said switching means by the delayed signal from said delay means.

* * * * *